US009327895B2

(12) United States Patent
Robertson et al.

(10) Patent No.: US 9,327,895 B2
(45) Date of Patent: May 3, 2016

(54) CONTAINER HAVING EMBOSSED OUTER SLEEVE

(71) Applicant: Huhtamaki, Inc., De Soto, KS (US)

(72) Inventors: Ronald D. Robertson, Kansas City, MO (US); James Edwin Winship, Lee's Summit, MO (US)

(73) Assignee: HUHTAMAKI, INC., De Soto, KS (US)

( * ) Notice: Subject to any disclaimer, the term of this patent is extended or adjusted under 35 U.S.C. 154(b) by 0 days.

(21) Appl. No.: 14/201,822

(22) Filed: Mar. 8, 2014

(65) Prior Publication Data

US 2014/0263367 A1 Sep. 18, 2014

Related U.S. Application Data

(60) Provisional application No. 61/788,799, filed on Mar. 15, 2013.

(51) Int. Cl.

| | |
|---|---|
| ***B65D 3/22*** | (2006.01) |
| ***B65D 81/38*** | (2006.01) |
| ***B65D 1/26*** | (2006.01) |
| ***B65D 21/02*** | (2006.01) |
| ***A47G 23/02*** | (2006.01) |

(52) U.S. Cl.

CPC ..... *B65D 81/3876* (2013.01); *A47G 23/0216* (2013.01); *B65D 1/265* (2013.01); *B65D 3/22* (2013.01); *B65D 21/0233* (2013.01); *B65D 81/3869* (2013.01); *B65D 81/3874* (2013.01)

(58) Field of Classification Search

CPC .. B65D 81/3869; B65D 3/22; B65D 81/3876; B65D 1/265; B65D 21/0233; A47G 23/0216

USPC ..... 220/903, 592.17, 592.2, 592.23, 220/592.24, 592.25, 62.12, 62.18, 739; 229/403; 206/519, 515, 499

See application file for complete search history.

(56) References Cited

U.S. PATENT DOCUMENTS

| | | | | |
|---|---|---|---|---|
| 2,028,566 | A * | 1/1936 | Seipel et al. | 294/31.2 |
| 5,685,480 | A * | 11/1997 | Choi | 229/403 |
| 5,820,016 | A * | 10/1998 | Stropkay | 229/403 |
| 6,053,352 | A * | 4/2000 | Cai | 220/739 |
| 7,828,199 | B2 | 11/2010 | Robertson et al. | |
| 7,922,071 | B2 | 4/2011 | Robertson et al. | |
| 2006/0226210 | A1 * | 10/2006 | Stahlecker | 229/403 |
| 2012/0097685 | A1 * | 4/2012 | Babinsky et al. | 220/592.2 |

* cited by examiner

*Primary Examiner* — Jeffrey Allen
*Assistant Examiner* — Jennifer Castriotta
(74) *Attorney, Agent, or Firm* — Husch Blackwell LLP

(57) ABSTRACT

A multi-walled container comprising a receptacle and outer sleeve having an embossment formed therein is provided. An insulating layer may be defined or provided between the receptacle and outer sleeve. The outer sleeve has an embossment provided at least partially therearound for engaging the upper lip of a second container when multiple containers are nested or stacked one within another. The embossment may be a continuous circumferential rib formed around substantially the entire perimeter of the sleeve or may be a plurality of ribs formed intermittently around the perimeter of the sleeve. In order for the embossment to contact or engage the upper lip of another container, the embossment preferably has a diameter that is larger than a diameter of an opening defined by the receptacle upper lip. The outer sleeve can be fixedly attached to the insulating layer or receptacle at locations both above and below the embossment.

14 Claims, 5 Drawing Sheets

CONTAINER HAVING EMBOSSED OUTER SLEEVE

CROSS-REFERENCE TO RELATED APPLICATIONS

This application claims priority to U.S. Provisional Patent Application Ser. No. 61/788,799, filed on Mar. 15, 2013, to Ronald D. Robertson entitled "Container Having Embossed Outer Sleeve," currently pending, the entire disclosure of which is incorporated herein by reference.

BACKGROUND OF THE INVENTION

Insulated containers suitable for holding hot liquids, such as coffee, hot chocolate, soup and the like, are well known in the food and beverage packaging industry. Such containers are typically stacked or nested one within the other during shipment, storage and dispensing.

Many existing containers are "bottom stacked" meaning that, when multiple containers are stacked or nested, the lower peripheral footing of an inner container comes to rest on the bottom wall of an outer container. Therefore, a small gap may or may not exist between the sidewalls of the inner and outer containers. If insulation is added to the outer surface of the sidewall of the container, the bottom wall of the container typically must be raised so that the footing on the inner container comes to rest on the bottom wall of the outer container before the sidewalls of the containers become wedged together in an interference fit. If the bottom wall is not raised, it can result in multiple containers inadvertently sticking together when a user intends to grab only one container from the stack. However, raising the bottom wall (i.e., increasing the height of the peripheral footing) results in a more complex container construction and increases the chances of the container leaking. It also reduces the volumetric capacity of the container.

As such, a need exists for an insulated container that may be generally fully nested with other containers without becoming wedged in or stuck to the other containers.

SUMMARY OF THE INVENTION

One embodiment of the present invention is generally directed to a multi-walled container comprising a receptacle, an intermediate insulating layer and an outer sleeve. The receptacle may be constructed of a paperboard material and can include a circumferential sidewall with an outwardly rolled upper lip. The insulating layer can be defined or provided between the receptacle sidewall and the outer sleeve. In one embodiment, the insulating layer is constructed of a foamed material, though other insulating materials are also within the scope of the invention. The insulating layer may alternatively be disposed around and fixedly attached directly to the receptacle sidewall.

The outer sleeve, which may also be constructed of a paperboard material, includes an outwardly projecting embossment or rib designed for engaging the upper lip of another container when two or more containers are stacked or nested one within the other. The embossment may be a continuous circumferential rib formed around substantially the entire perimeter, or at least a portion of the perimeter, of the sleeve or may be a plurality of spaced-apart ribs formed around at least a portion of the perimeter of the sleeve. In order for the embossment to contact or engage the upper lip of another container, the embossment preferably has a diameter that is larger than a diameter of an opening defined by the receptacle upper lip.

In one embodiment, the sleeve is disposed around and fixedly attached to the insulating layer. In another embodiment, the sleeve is attached directly to the receptacle sidewall. In that manner, the sleeve can be securely attached to the insulating layer (or receptacle sidewall, as the case may be) at locations both above and below the embossment in order to prevent the embossment from ironing out or collapsing. The engagement of the embossment with the upper lip of another container causes a slight separation or gap between the containers. Specifically, a gap may be defined between the outer surface of the sleeve of an inner container and the inner surface of the receptacle sidewall of an outer container. The gap between two nested containers can permit the void space defined between the bottom walls of the inner and outer containers to be in fluid communication with the atmosphere so as not to create a vacuum in the void space which may impede the containers from being separated from one another. The gap may also prevent the two nested containers from becoming wedged together in an interference fit. According, the embossment can ensure that two or more containers do not become inadvertently stuck together when a user intends to grab only one container from the stack.

In a method of manufacture, the receptacle may be formed in a conventional manner by cutting the sidewall from a sheet or roll of material, wrapping the sidewall around a mandrel and affixing its marginal edge portions to one another to form an overlapping side seam. The outwardly rolled lip may be formed at an upper end of the sidewall and a bottom wall may be secured to a lower end of the sidewall. The insulating layer can be cut from an insulation material and may be optionally attached to the outer surface of the receptacle sidewall. The outer sleeve can be cut from a sheet or roll of material and the embossment may be formed therein. The sleeve can then be wrapped around and fixedly attached to the insulating layer (or directly to the receptacle sidewall, as the case may be) with adhesive, glue, sealant, melt or the like. The attachment of the sleeve may occur at locations both above and below the sleeve's embossment.

Other aspects and advantages of the present invention will be apparent from the following detailed description of the preferred embodiments and the accompanying drawing figures.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
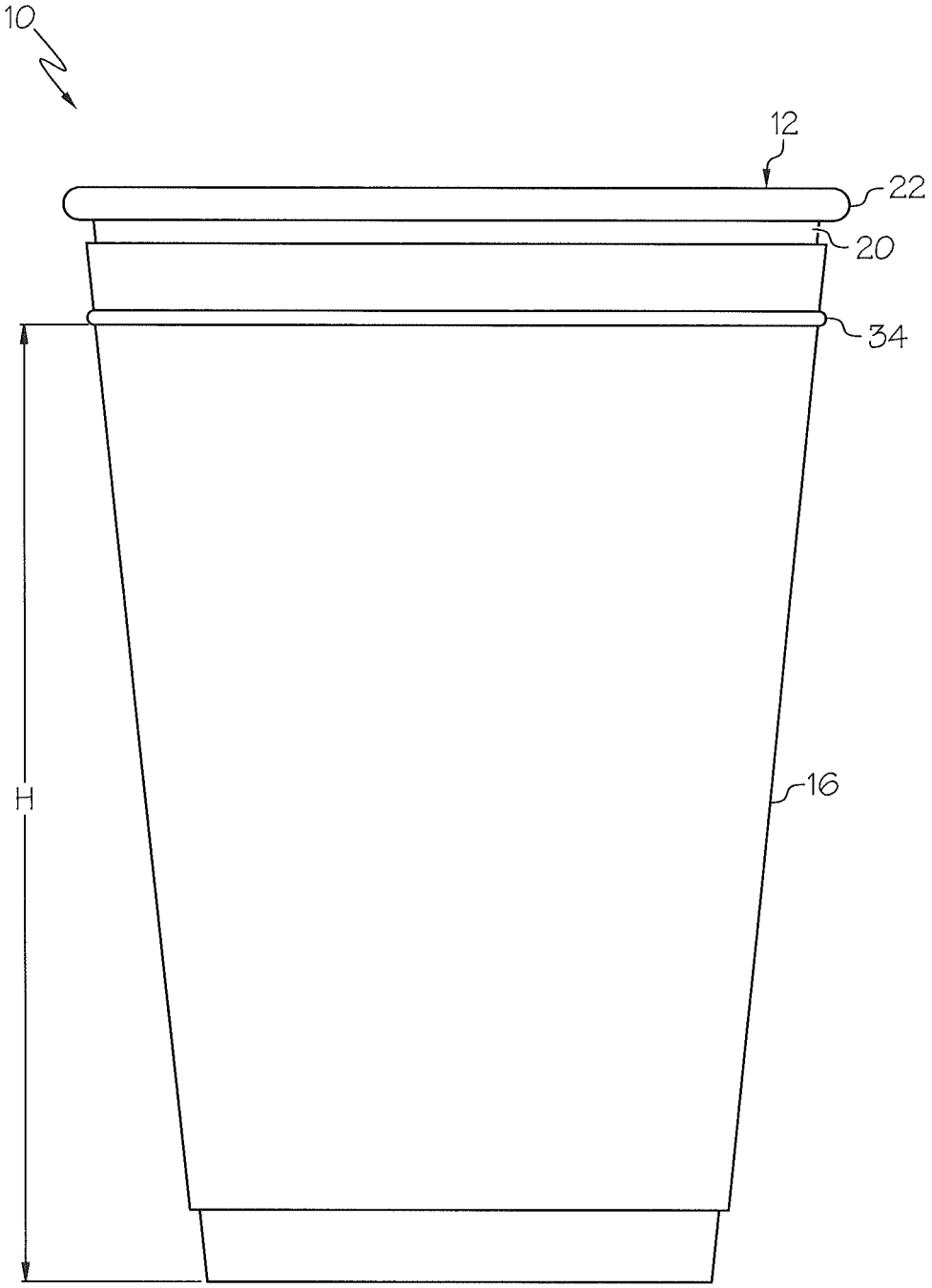
FIG. 1 is a side view of a container constructed according to one embodiment of the present invention.
Figure 2:
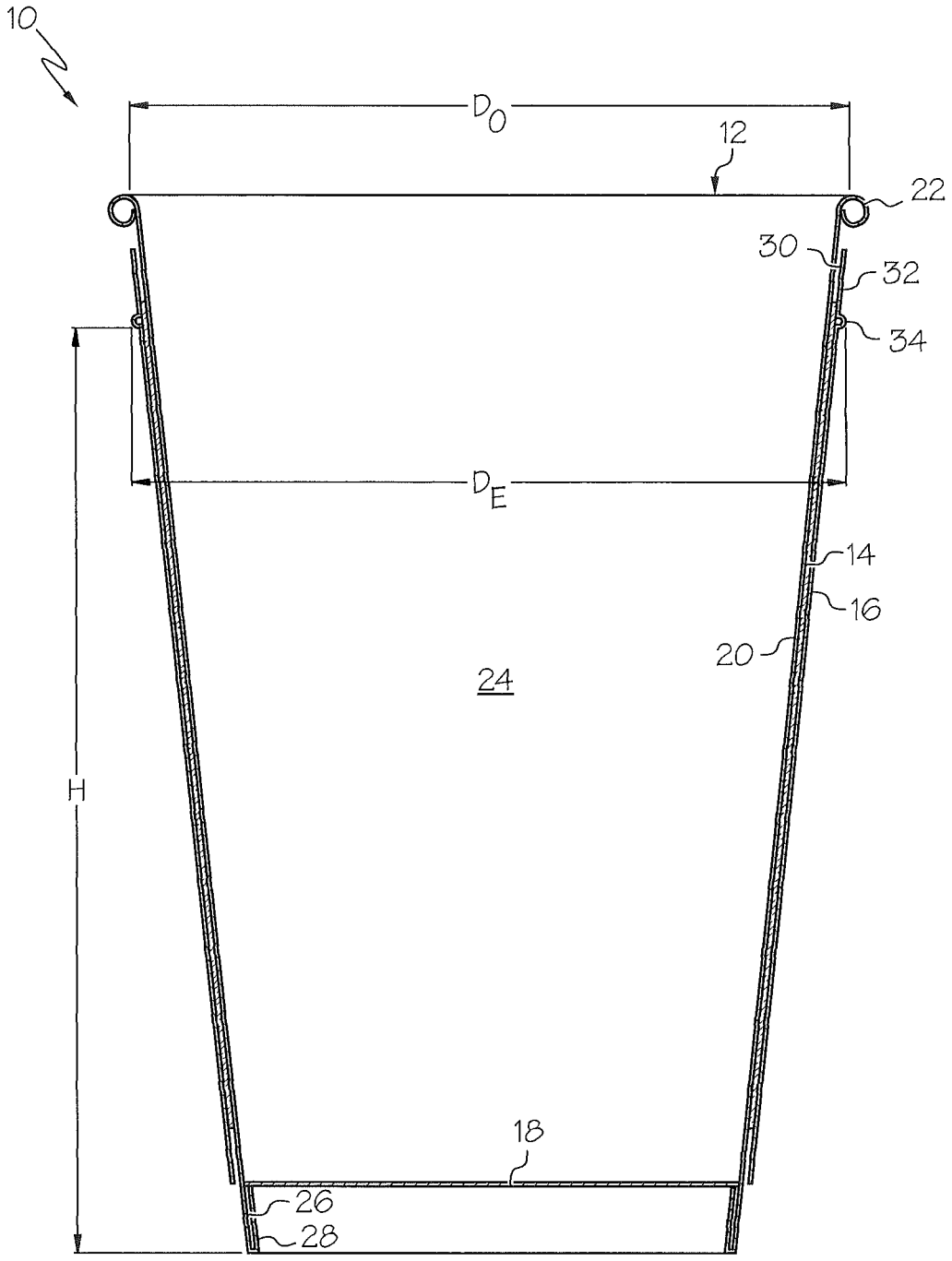
FIG. 2 is a sectional view of a container constructed according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Referring to the figures, one embodiment of the present invention is directed to a cup or container 10 that includes an inner receptacle 12, an intermediate insulating layer 14 and outer sleeve 16 disposed or wrapped therearound. While the container 10 may be adapted for holding food and drink, it will be appreciated that it can also be used in connection with the storage and transportation of other items.

The receptacle 12 may be formed of a circular bottom wall 18 and a circumferential sidewall 20 having an outwardly rolled upper lip 22, although other constructions are within the scope of the invention. In one embodiment, the receptacle 12 is constructed of paperboard, and preferably coated paperboard, in order to resist the migration of liquids contained within the storage chamber 24. The bottom wall 18 and sidewall 20 can be die cut from a larger sheet or roll (not shown) of material. As shown, the bottom wall 18 includes a depending skirt 26 which is secured to the sidewall 20 by a reverse bend 28 portion of the sidewall 20. Securement may be achieved by adhesive, sonic welding, sealants or the like. The reverse bend 28 forms a footing upon which the container may sit when in use. Construction of the receptacle 12 as just described is well known in the art.

The receptacle 12 preferably has a generally frustoconical shape with a generally circular transverse cross sectional shape of varying diameter that increases in size from a bottom end of the receptacle 12 to a top end of the receptacle 12. The taper of the sidewall 20 permits nesting for storage and shipping. The sidewall 20 can be formed from a blank and wrapped around a mandrel. The sidewall 20 may include an overlapping seam (not shown) extending generally longitudinally between the top and bottom ends of the receptacle 12. The seam (not shown) can be formed by adhering the overlapping margin portions of the sidewall 20 together with adhesive, sonic welding or the like. The exposed edges of the sidewall 20 at the seam can be sealed to prevent the migration of liquids into the material comprising the sidewall 20. The container 10 of the present invention can have a chamber 24 volume on the order of, for example, about 4 fluid ounces to about 16 fluid ounces although, larger or smaller containers 10 can be made.

An insulating layer 14 may be defined between the receptacle sidewall 20 and the sleeve 16 in order to protect a user's fingers and palm from the discomfort usually associated with holding a hot beverage. In one embodiment, the insulating layer 14 is disposed around the receptacle sidewall 20 and may be formed of a thermoplastic synthetic resin or a low-to-medium density foamed polymer, including but not limited to, polyethylene, polyolefin, polyvinylchloride, polystyrene, polyester, nylon or materials suitable for use as an insulating layer. It is also within the scope of the invention to create the insulating layer 14 from a paper material of various forms including, corrugated paper, paper with dimpled surfaces, low density paper, recycled paper, deformed paper or the like. Other suitable insulating materials may alternatively be utilized. Such an insulating layer 14 may also comprise at least some amount of void space or air. The insulating layer 14 may be between about 5 to 30 mils in one embodiment and between 10 and 20 mils in another embodiment. The insulating layer 14 may be secured or fixedly attached to the sidewall 20 to prevent unraveling and to prevent relative movement in a longitudinal or axial direction.

In another embodiment, the insulating layer may be in the form of an air gap defined between the receptacle sidewall 20 and the sleeve 16. This air gap can be formed, for example, by a standoff between the receptacle sidewall 20 and sleeve 16 created by inwardly directed protuberances (not shown) formed in the sleeve 16 that engage an outer surface 40 of the sidewall 20, as taught by U.S. Pat. No. 7,922,071 to Robertson et al. entitled "Multi Walled Container and Method," the entire disclosure of which is incorporated herein by reference. It will further be appreciated that, in further embodiments, such protuberances are not provide, but yet the sleeve 16 is nonetheless attached directly or indirectly to the receptacle sidewall 20.

As illustrated in the figures, an outer sleeve 16 surrounds and overlies a substantial portion of the sidewall 20. The sleeve 16 may be constructed from a flat blank of paperboard material or other suitable material and has interior and exterior surfaces 30 and 32. The exterior surface 32 may be suitable for having advertising, logos and other graphics printed thereon. An outwardly projecting rib or embossment 34 is formed into the sleeve 16. The embossment 34 may be in the form of a protuberance, deformation, distortion, bend, bulge, bump, lump, hump, knob, swelling or protrusion extending outwardly from a sidewall forming the sleeve 16. In one embodiment, the embossment 34 is formed around substantially continuously around entire perimeter of the sleeve 16, while another embodiment comprises multiple embossments 16 formed intermittently around the perimeter of the sleeve 16. The embossment 34 may be formed, for example, by an embossing roller, press plate, pins, or die plate and may be embossed while the sleeve 16 is still in flat form prior to being wrapped around the receptacle 12 and/or insulating layer 14. In one embodiment, the embossment 34 may be formed while the sleeve 16 is on a printing press or die cutter. The embossment 34 may be pressed, stamped or rolled into the sleeve simultaneously, or in close temporal and spatial proximity with, with the die cutting or printing of the sleeve 16. In another embodiment, the embossment 34 is formed by applying, adding or forming additional material along the outer surface 32 of the sleeve 16. The embossment 34 may also be formed by swelling or expanding the material forming the sleeve 34 in the area of the embossment 34 through, for example, causing moisture to be absorbed or adsorbed into the paperboard or other material forming the sleeve 16.

Figure 5:
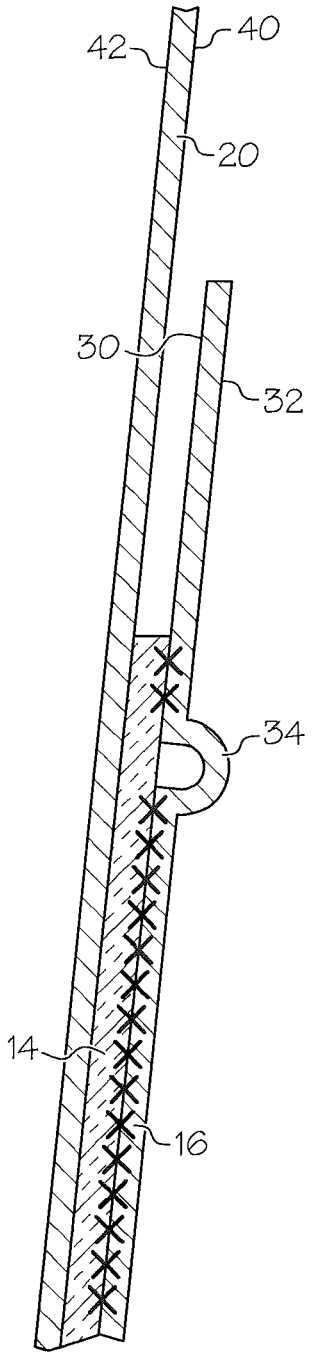
FIG. 5 is an enlarged schematic sectional view illustrating the placement of an adhesive adhering the sleeve to the insulating layer in accordance with one embodiment of the present invention.

The sleeve 16 may be disposed around and fixedly attached to the insulating layer 14 as shown in FIG. 5 with adhesive, glue, sealant, melt or the like. The adhesive, which is schematically represented by a plurality of "X's," can be placed above and below the embossment 34. Securely attaching the sleeve 16 to the insulating layer 14 directly above and below the embossment 34 may prevent the embossment 34 from ironing out or collapsing. This may be especially advantageous when stacked containers 10 are transported or stored in higher temperature environments. Likewise, in an embodiment wherein the sleeve 16 is attached directly to the receptacle sidewall 20, the sleeve 16 may be attached above and below the embossment 34 to prevent the embossment 34 from ironing out or collapsing.

Figure 3:
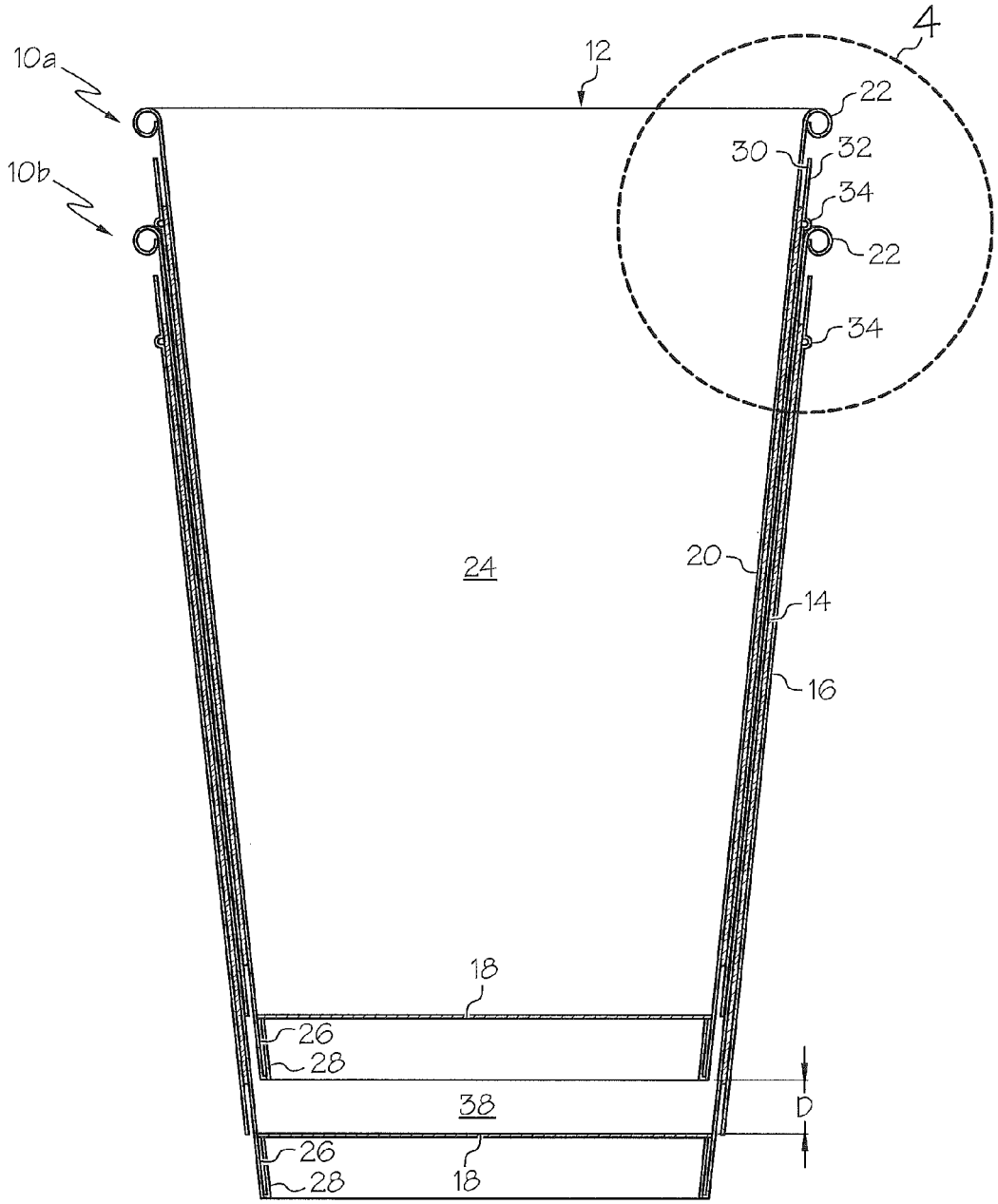
FIG. 3 is a sectional view of two nested containers constructed according to one embodiment of the present invention.
Figure 4:
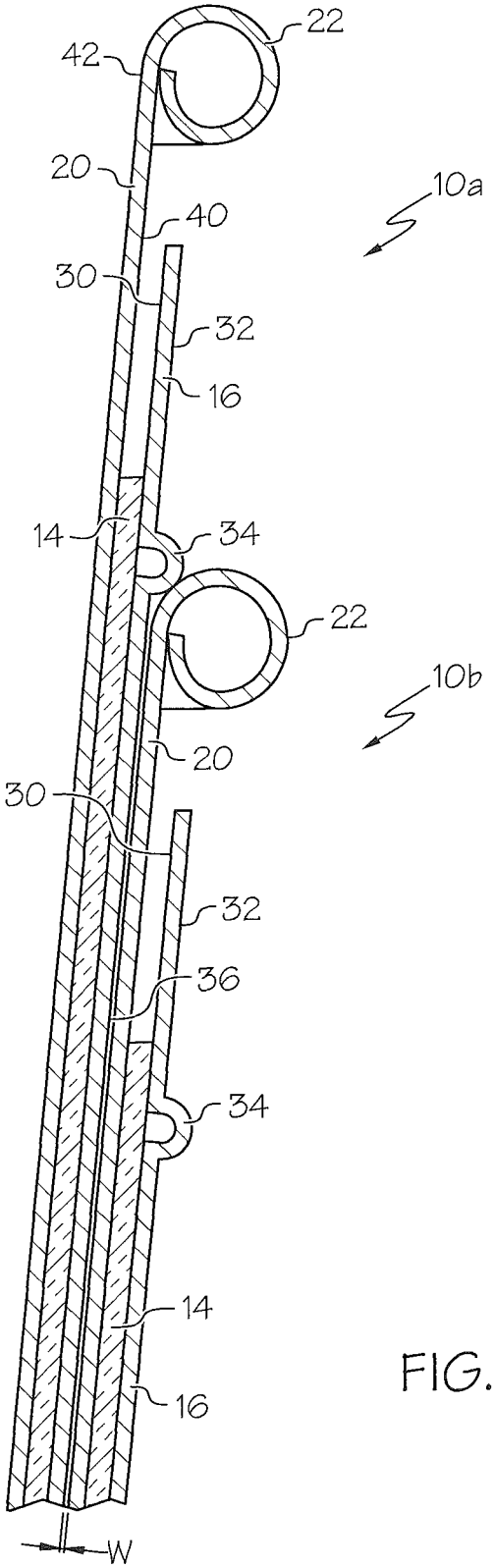
FIG. 4 is an enlarged sectional view of a portion of the containers in balloon 4 of FIG. 3.

As demonstrated in FIGS. 3 and 4, the embossment 34 of the inner container 10*a* contacts or engages the rolled upper lip 22 of the outer container 10*b* to control the degree of nesting between the two containers 10*a* and 10*b*. In that regard, the embossment 34 may have a diameter $D_E$ that is larger than a diameter $D_O$ of an opening defined by the upper lip 22. The inner container 10*a* is held up by its embossment 34 and not permitted to fall so far into the outer container 10*b* so as to become wedged therein. A distance D is maintained between the footing of the inner container 10*a* and the bottom wall 18 of the outer container 10*b*, as the two containers 10*a* and 10*b* are not "bottom stacked" as described above.

As shown in FIG. 4, the embossment 34 causes a slight separation or gap 36 between the containers 10*a* and 10*b*. Specifically, the gap 36 is defined between the outer surface 32 of the sleeve 16 of the inner container 10*a* and the inner surface 42 of the receptacle sidewall 20 of the outer container 10*b*. The gap 36 between two nested containers 10*a* and 10*b* can permit the void space 38 beneath the inner container 10*a* to be in fluid communication with the atmosphere so as not to create a vacuum in the void space 28 between the two containers 10*a* and 10*b* which may impede their separation from one another. Such resistance to separation can result in multiple containers 10 sticking together when the user intends to grab only one from the stack. The gap 36 also prevents the two containers 10*a* and 10*b* from becoming wedged together in an interference fit. The width W of the gap 36 and degree of nesting between stacked containers is dependent upon the vertical placement or height H of the embossment. For a greater gap 36 width W, the embossment 34 is placed at a slightly lower height H and for a smaller gap 36 width W, the embossment 34 is placed at a slightly greater height H.

As demonstrated in the figures, the sleeve 16 is adhesively attached to the insulating layer 14. However, it will be appreciated that, in other embodiments, the container 10 may not include an insulating layer 14 and the sleeve 16 may be applied directly to the receptacle 12. In further embodiments, the embossment 34 may be formed directly into receptacle sidewall 20.

It will be appreciated that the insulating layer 14 and outer sleeve 16 may be manufactured independently from the receptacle 12 and later applied to the receptacle 12. In that manner, one embodiment of the present invention is directed to a frustoconical insulating wrapper that is adapted for placement around a receptacle 12. Such an insulating wrapper may be constructed from an insulating layer 14 and sleeve 16 as described above.

In a method of manufacture, the receptacle 12 may be formed in a conventional manner by cutting the sidewall 20 from a sheet or roll of material, wrapping the sidewall 20 around a mandrel (not shown) and then affixing the marginal edge portions of the sidewall 20 to one another to form an overlapping side seam. The outwardly rolled lip 22 may be formed at an upper end of the sidewall 20 and the bottom wall 18 may be secured to a lower end of the sidewall 20. The insulating layer 14 may be cut from an insulation material, for example, one of the materials described above. The insulating layer 14 may be optionally attached to the outer surface 40 of the receptacle sidewall 20. The outer sleeve 16 can be cut from a sheet or roll of material, for example, a paperboard material. As set forth above, the embossment 34 may be formed into the sleeve 16, for example, by an embossing roller, press plate, pins, or die plate and may be embossed while the sleeve 16 is still in flat form prior to being wrapped around the receptacle 12 and/or insulating layer 14. In one embodiment, the embossment 34 may be formed while the sleeve 16 is on a printing press or die cutter. The sleeve 16 may then be wrapped around and fixedly attached to the insulating layer 14 or receptacle sidewall 20 with adhesive, glue, sealant, melt or the like. The attachment may occur at locations both above and below the embossment 34.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A multi-walled container, said container comprising:

a receptacle having a circumferential sidewall with an upper lip;

an outer sleeve having an inner surface and an outer surface and having a continuous outwardly projecting embossment spanning circumferentially around the entire perimeter of said sleeve for engaging an upper lip of a second container when said container is nested within said second container; and an insulating layer between said sidewall and said sleeve;

wherein said sleeve is affixed to said insulating layer at a location above said embossment and a location below said embossment;

wherein said insulating layer extends between said locations above and below said embossment such that said insulating layer is disposed between said sidewall and said embossment;

wherein said inner surface of said outer sleeve is spaced apart from said circumferential sidewall of said receptacle along the entire height of said outer sleeve;

wherein said inner surface of said outer sleeve is parallel to said circumferential sidewall of said receptacle along the entire height of said outer sleeve except at said embossment.

2. The container of claim 1, wherein said sleeve is constructed of a paperboard material and said embossment is formed into said paperboard material.

3. The container of claim 1, wherein said insulating layer is constructed from at least one of thermoplastic synthetic resin, foamed polymer, corrugated paper, paper with dimpled surfaces, low density paper, recycled paper, deformed paper and air.

4. The container of claim 1, wherein said insulating layer is disposed around said receptacle sidewall and said sleeve is disposed around said insulating layer.

5. The container of claim 1 further comprising adhesive affixing said sleeve to said insulating layer, said adhesive being located above said embossment and below said embossment.

6. The container of claim 1, wherein said embossment is a continuous circumferential rib.

7. The container of claim 1, wherein said embossment has a diameter that is larger than a diameter of an opening defined by said receptacle upper lip.

8. The container of claim 1, wherein said embossment is located at a height above a bottom of said receptacle such that a gap is defined between an outer surface of said sleeve of said container and an inner surface of said sidewall of said receptacle of said second container when said container is nested within said second container.

9. A multi-walled container, said container comprising:

a receptacle having a circumferential sidewall with an upper lip;

an insulating layer disposed around at least a portion of said receptacle sidewall; and an outer sleeve constructed of a paperboard material disposed around said insulating layer, said sleeve having an inner surface and an outer surface and including an outwardly projecting embossment formed in said paperboard material for engaging an upper lip of a second container when said container is nested within said second container;

wherein said sleeve is fixedly attached to said insulating layer at locations above and below said embossment;

wherein said insulating layer is disposed between said sidewall and said embossment;

wherein said embossment has an outer diameter that is larger than a diameter of an opening defined by an upper lip of said second container;

wherein said inner surface of said outer sleeve is spaced apart from said circumferential sidewall of said receptacle along the entire height of said outer sleeve;

wherein said inner surface of said outer sleeve is parallel to said circumferential sidewall of said receptacle along the entire height of said outer sleeve except at said embossment.

10. In combination, a plurality of containers, said combination comprising:

a first container including a receptacle having a circumferential sidewall, an outer sleeve having an inner surface and an outer surface and having an outwardly projecting embossment spanning continuously around the entire perimeter of said outer sleeve, and an insulating layer disposed between said sidewall and said outer sleeve and embossment such that said insulating layer separates said embossment from said sidewall, wherein said inner surface of said outer sleeve maintains a standoff from said receptacle sidewall throughout the entire height of said outer sleeve so that said outer sleeve and said receptacle sidewall do not contact one another, and wherein said inner surface of said outer sleeve maintains a parallel relationship with said receptacle sidewall throughout the entire height of said outer sleeve except at said embossment; and a second container including a receptacle having a circumferential sidewall with an upper lip defining an opening;

wherein said embossment of said first container engages said upper lip of said second container when said first container is nested within said second container.

11. The combination of claim 10, wherein said sleeve is constructed of a paperboard material and said embossment is formed into said paperboard material.

12. The combination of claim 10 further comprising a gap defined between an outer surface of said first container sleeve and an inner surface of said second container sidewall.

13. A frustoconical insulating wrapper adapted for placement around a frustoconical container, said wrapper comprising:

an inner insulating layer; and an outer sleeve having an inner surface and an outer surface and including a continuous outwardly projecting embossment extending substantially across an entire length of said sleeve for engaging an upper lip of a second container when said container is nested within said second container;

wherein said insulating layer is fixedly attached to an interior surface of said outer sleeve at a location above said embossment and a location below said embossment, and where said insulating layer spans between said locations above and below said embossment;

wherein said insulating layer separates said outer sleeve from said container when said wrapper is positioned around said container so that said inner surface of said outer sleeve does not contact said container and said inner surface of said outer sleeve is parallel to said container along the entire height of said outer sleeve except at said embossment.

14. The insulating wrapper of claim 13, wherein said embossment has an outer diameter that is larger than a diameter of an opening defined by an upper lip of said second container.

* * * * *